US012252847B2

(12) United States Patent
Fürst

(10) Patent No.: US 12,252,847 B2
(45) Date of Patent: Mar. 18, 2025

(54) TURNOUT ARRANGEMENT WITH ELASTICALLY SUPPORTED TURNOUT BASES

(71) Applicant: PORR Bau GmbH, Vienna (AT)

(72) Inventor: Johannes Fürst, Riederberg (AT)

(73) Assignee: PORR Bau GmbH, Vienna (AT)

( * ) Notice: Subject to any disclaimer, the term of this patent is extended or adjusted under 35 U.S.C. 154(b) by 973 days.

(21) Appl. No.: 17/273,589

(22) PCT Filed: Sep. 6, 2019

(86) PCT No.: PCT/EP2019/073834
§ 371 (c)(1),
(2) Date: Mar. 4, 2021

(87) PCT Pub. No.: WO2020/049156
PCT Pub. Date: Mar. 12, 2020

(65) Prior Publication Data

US 2021/0332532 A1 Oct. 28, 2021

(30) Foreign Application Priority Data

Sep. 7, 2018 (AT) ..... A 50763/2018

(51) Int. Cl.
*E01B 1/00* (2006.01)
*E01B 3/40* (2006.01)
*E01B 7/22* (2006.01)

(52) U.S. Cl.
CPC ..... *E01B 1/004* (2013.01); *E01B 1/002* (2013.01); *E01B 3/40* (2013.01); *E01B 7/22* (2013.01);

(Continued)

(58) Field of Classification Search
CPC ..... E01B 1/004; E01B 1/002; E01B 2204/01; E01B 2204/09; E01B 1/00; E01B 1/001; E01B 3/40; E01B 7/22
See application file for complete search history.

(56) References Cited

U.S. PATENT DOCUMENTS 10,435,849 B2 * 10/2019 Tusino ..... E01B 3/40

FOREIGN PATENT DOCUMENTS

CN 202064239 U 12/2011
CN 203700880 U * 7/2014
(Continued)

OTHER PUBLICATIONS

Search Report and Written Opinion dated Feb. 25, 2021 of International Application No. PCT/EP2019/073834.

*Primary Examiner* — S. Joseph Morano
*Assistant Examiner* — Cheng Lin
(74) *Attorney, Agent, or Firm* — Gordon & Jacobson, P.C.

(57) ABSTRACT

A turnout arrangement of a slab track with a ballastless superstructure for forming a main track (1) and a branch track (2) which branches off from the main track for railway traffic has a plurality of prefabricated turnout bases (3) of untensioned reinforced concrete, a casting compound (5), which is cast and hardened between the aligned turnout bases and the ground (4), a plurality of fastening areas (6) which are rail support points (7) provided on the turnout bases for the rail fastening of the main track, the branch track, and further turnout components. The turnout bases of the turnout arrangement are elastically supported, and each turnout base is provided with a positive-locking arrangement for positively holding the turnout base horizontally with respect to the casting compound. An elastic layer (8) is (Continued)

provided between a projection (13) of an element of the positive-locking arrangement and the turnout base.

20 Claims, 2 Drawing Sheets

(52) U.S. Cl.
CPC ..... *E01B 2204/01* (2013.01); *E01B 2204/09* (2013.01)

(56) References Cited

FOREIGN PATENT DOCUMENTS

| | | | | | | |
|---|---|---|---|---|---|---|
| CN | 105200868 | A | | 12/2015 | | |
| CN | 205242181 | U | * | 5/2016 | | |
| DE | 102008016953 | A1 | * | 10/2009 | ..... | E01B 1/004 |
| DE | 102015205484 | A1 | | 10/2015 | | |
| EP | 1231323 | A2 | * | 8/2002 | ..... | E01B 1/004 |
| ES | 2329723 | T3 | * | 11/2009 | ..... | E01B 19/00 |
| JP | 2003055901 | A | * | 2/2003 | ..... | E01B 1/005 |

* cited by examiner

TURNOUT ARRANGEMENT WITH ELASTICALLY SUPPORTED TURNOUT BASES

CROSS-REFERENCE TO RELATED APPLICATION(S)

This application is the National Stage of International Patent Application No. PCT/EP2019/073834 filed on Sep. 6, 2019, which claims priority from Austrian Patent Application No. A50763/2018 filed on Sep. 7, 2018, both of which are herein incorporated by reference herein in their entireties.

BACKGROUND

The invention relates to a turnout arrangement of a slab track having a ballastless superstructure for forming a main track and a branch track, which branches off from the main track, for railway traffic and a track arrangement comprising a turnout arrangement and a plurality of tracks adjoining the junctions of the turnout arrangement.

In particular, the invention relates to a turnout arrangement and a track.

So called slab tracks, which comprise a ballastless superstructure, are known from and published in various embodiments.

In the case of slab tracks, depending on the design, prefabricated bases made of reinforced concrete can be aligned in a first step at a distance from, for example, a cement- or bituminous-bonded base layer, such as in particular a ground designed as a concrete foundation or asphalt foundation. The remaining spaces between the bases and the ground may, for example, be filled with a hardening casting compound.

While some known systems include rigidly cast-in bases, in which elastic support of the rails is only provided at the rail support points, a system is also known in which the bases are elastically supported.

However, in the known system with elastically supported bases, the turnout areas have so far been rigidly designed.

The reason for this is that, at a turnout, the branch track branches off from a main track in a curve. In contrast to conventional curves of a track, this curve of the turnout is not designed to be superelevated. As a result, considerably higher lateral forces occur when passing the curve of a turnout than with conventional superelevated curves. Furthermore, track bases for turnouts are usually more expensive to manufacture than conventional turnout designs.

In particular in the case of curved tracks without superelevation, impacts and jerky application of forces can occur, for example when the wheel rims are contacted. In order to absorb these force peaks, sufficiently dimensioned positive-locking elements are necessary to positively connect the bases with the casting compound. In the area of the turnout, however, the space for positive-locking elements is severely limited, since in addition to the fastening areas for the main track, the fastening areas for the branch track and in particular for other turnout components must also be kept free. Further turnout components are, for example, the turnout tongues together with the switch mechanism and, depending on the definition, optionally also the frog, the check rails, the drive mechanism and/or the wing rails.

Practice has shown that a discontinuity in the stiffness of the track arrangement occurs during the transition of a rail vehicle from the elastically supported track bases to a rigidly supported turnout. This discontinuity can be perceived as a jolt. In addition, driving comfort is also impaired by the fact that noise emissions are increased in the area of the rigid turnout.

SUMMARY

It is now the object of the invention to create a turnout arrangement of a slab track which, despite the relatively unfavourable curve design without superelevation, allows an increased driving comfort and which, moreover, can be manufactured efficiently.

Surprisingly, it has been found that force peaks and especially impacts can be elastically absorbed in particular by an elastic support of the bases in the turnout area, whereby the remaining space on the turnout bases is sufficient, contrary to previous assumptions, to be able to provide sufficiently dimensioned positive-locking elements.

In particular, the invention relates to a turnout arrangement of a slab track with a ballastless superstructure for forming a main track and a branch track, which branches off from the main track, for railway traffic comprising a plurality of prefabricated turnout bases of reinforced concrete, in particular untensioned reinforced concrete, a casting compound, which is cast and hardened between the aligned turnout bases and a ground, a plurality of fastening areas, in particular rail support points, which are provided on the turnout bases for the rail fastening of the main track and the branch track as well as for fastening further turnout components.

According to the invention, it is provided that the turnout bases of the turnout arrangement are elastically supported or mounted.

Optionally, it is provided that the turnout bases of the turnout arrangement are elastically supported individually, and in particular supported free of constraint forces.

Optionally, it is provided that the turnout bases are elastically supported with respect to the ground.

Optionally, it is provided that the turnout bases are elastically supported horizontally with respect to the ground and in particular transversely to the course of the track.

Optionally, it is provided that the turnout bases are elastically supported horizontally with respect to each other and in particular transversely to the course of the track.

Optionally, it is provided that a gap is kept free between each of the turnout bases, and, optionally, that an elastic support with respect to each other is achieved by the elastic support with respect to the ground.

Optionally, it is provided that the turnout bases are elastically supported in the vertical direction.

Optionally, it is provided that an elastic layer, which is optionally formed in several parts, is arranged between the turnout bases and the casting compound for an elastic support and in particular for an elastic decoupling of the turnout bases.

Optionally, it is provided that at least one positive-locking arrangement is provided per turnout base for positively holding the turnout base horizontally with respect to the casting compound.

Optionally, it is provided that the positive-locking arrangement comprises two positive-locking elements, which are in positive active contact with one another.

Optionally, it is provided that one or the elastic layer is arranged between each of the two positive-locking elements of the positive-locking arrangement for the horizontal elastic support and in particular for the elastic decoupling of the turnout base.

Optionally, it is provided that at least one positive-locking arrangement is provided per turnout base for positively holding the turnout base vertically with respect to the casting compound.

Optionally, it is provided that the positive-locking arrangement comprises two positive-locking elements, which are in positive active contact with one another.

Optionally, it is provided that one or the elastic layer is arranged between each of the two positive-locking elements of the positive-locking arrangement for the vertical elastic support and in particular for the elastic decoupling of the turnout base.

Optionally, it is provided that one positive-locking element of the positive-locking arrangement is an opening kept free in the turnout base and in particular a casting opening, and in that the other positive-locking element is a projection of the hardened casting compound extending into this opening.

Optionally, it is provided that the positive-locking element formed as a projection has an undercut and, in particular, a region located at the top protrudes beyond a region located further down in the horizontal direction or is designed to widen towards the top.

Optionally, it is provided that a part of the turnout base extends into the undercut of the projection so that a vertical positive connection is formed.

Optionally, it is provided that one or the elastic layer is provided between the projection and the turnout base.

Optionally, it is provided that two openings are provided per turnout base, into each of which protrudes a projection of the hardened casting compound.

Optionally, it is provided that the smallest overall cross section of the projections extending into a turnout base is bigger than the cross section which, taking into account the strength of the casting compound, is sufficient to absorb the horizontal forces, in particular the transverse forces and/or longitudinal forces introduced by a rail vehicle, without damage. This, of course, affects the strength of the hardened casting compound.

Optionally, it is provided that the projections and the openings of a turnout base or the turnout bases are dimensioned in such a way that the maximum compression of the elastic layer at the flanks of the openings in the limit state of the load-bearing capacity due to lateral forces is 150-250 $kN/m^2$, wherein, for example, the maximum compression of the elastic layer at the flanks of the openings in the limit state of the load-bearing capacity due to lateral forces is 150 $kN/m^2$ for metro turnouts (e.g. 16 t axle load), and wherein, for example, the maximum compression of the elastic layer on the flanks of the openings in the limit state of the load-bearing capacity due to lateral forces is 250 $kN/m^2$ for mainline turnouts with e.g. 22.5-25 t axle load. Preferably, the openings may serve as casting openings in all embodiments.

Optionally, it is provided that the turnout bases, in particular all turnout bases of the turnout arrangement, are of substantially rectangular design and have a greater dimension in the transverse direction of the course of the track than in the longitudinal direction of the course of the track.

Optionally, it is provided that the smaller dimension of the turnout bases is less than or equal to 2.6 m, in particular less than or equal to 2.1 m.

Optionally, it is provided that the turnout bases, in particular all turnout bases of the turnout arrangement, each extend continuously over the entire width of the turnout and comprise or form fastening areas for the main track and for the branch track at least after the frog of the turnout.

Optionally, it is provided that the elastic layer of a turnout base has other elasticity characteristics, in particular a different stiffness and/or a different shear modulus, than the elastic layer of another turnout base, in particular than the elastic layer of an adjacent turnout base.

Optionally, it is provided that the elastic layer has a static stiffness (at room temperature) in the range of 0.15-0.6 $N/mm^3$, wherein for example for metro turnouts a static stiffness in the range of 0.15-0.3 $N/mm^3$ is used and for example for mainline turnouts a static stiffness in the range of 0.2-0.6 $N/mm^3$ is used.

In particular, the invention relates to a track arrangement, comprising a turnout arrangement according to the invention and a plurality of tracks adjoining the junctions of the turnout arrangement, wherein the tracks are configured as slab track with a ballastless superstructure and comprise the following components: a plurality of prefabricated track bases of reinforced concrete, in particular untensioned reinforced concrete, a casting compound, which is cast and hardened between the aligned track bases and the ground, a plurality of fastening areas, in particular rail support points, which are provided on the track bases for the rail fastening of the tracks.

According to the invention, it is provided that the track bases, in particular all bases, i.e. the track bases and the turnout bases, are elastically supported.

Optionally, it is provided that an elastic layer, which is optionally formed in several parts, is arranged between the track bases and the casting compound for the elastic support and in particular for the elastic decoupling of the track bases.

Optionally, it is provided that the elastic layer of one turnout base has other elasticity characteristics, in particular a different stiffness and/or a different shear modulus, than the elastic layer of a or an adjacent track base.

To form a turnout arrangement according to the invention and/or a track arrangement according to the invention, prefabricated bases, in particular turnout bases and track bases, are aligned with respect to the ground in a first step. The ground is usually a foundation following the course of the track, for example a concrete foundation or an asphalt foundation. The alignment is usually achieved by holding the bases at a distance from the ground by means of adjusting elements, such as threaded bolts, whereby an adjustment of the adjusting elements, in particular the threaded bolts, can be used to adjust the inclination and an alignment of the bases with respect to the ground.

Subsequently, the space between the ground and the bases is filled with a casting compound. In the arrangements according to the invention, the bases are preferably elastically supported with respect to the casting compound. This elastic support is achieved in particular by arranging an elastic layer between the bases and the casting compound. This elastic layer is preferably made of several parts. For example, it can be made of rubber granulate mats with selectable parameters such as thickness, particle size, hardness, in particular Shore hardness, shear modulus and/or void content. Alternatively, it can be made of a foam body, in particular polyurethane foam or a prefabricated elastic mat.

The elastic layers are usually already attached and, in particular, glued, to the undersides of the bases during fabrication. The bases are usually transported to the installation site as prefabricated finished parts. However, the bases can be custom-made, especially in the form of turnout bases, which are specially adapted to the installation sites. The casting compound is only applied at the installation site itself.

Preferably, the elastic layer in the area of one or each base is formed in such a way that the base does not come into direct contact with the casting compound at any point. In this way, the base is elastically supported with respect to the casting compound and decoupled in the sense of the invention. The elastic layer preferably rests flat on the base and on the casting compound.

In order to still be able to form a positive connection between the bases and the casting compound, a positive-locking arrangement is preferably provided for each base. According to a preferred embodiment, the positive-locking arrangement comprises two positive-locking elements, which are in positive active contact, in the area of a base. Thus, the base comprises an opening as the first positive-locking element, into which the casting compound is filled, so that the casting compound forms a projection in the area of the opening as the second positive-locking element. The opening of the base preferably runs substantially vertically and optionally extends through the entire base as a through-opening. In particular in this embodiment, the opening can also serve in a synergistic manner as a casting opening for introducing the hardenable casting compound.

In order to provide the described decoupling also in the area of the positive-locking arrangement, the base is preferably also provided with the elastic layer in this area. Thus, an elastic layer is preferably also provided between the opening of the base and the projection of the casting compound.

This configuration provides a positive connection, in particular a horizontally acting positive connection, which, however, has a certain elasticity or a certain stiffness due to the elastic layer between the base and the casting compound.

If horizontally acting forces, in particular transverse forces due to cornering or longitudinal forces, for example due to acceleration, are transmitted from the rails via the bases to the casting compound, shear forces act in the projections. The projections and the openings must therefore be designed in such a way that the total area of the cross-sections of the projections is dimensioned in such a way that the shear forces introduced are below the maximum permissible shear forces. In particular, the introduced horizontal forces must be below the maximum permissible load limit of the base and the projections.

Preferably, several openings are provided on a turnout base, whereby the remaining space can be optimally used. In particular, the size of the openings is also limited by the fact that the remaining turnout base must have sufficient strength with regard to the deflection due to vertical forces.

In a preferred manner, the turnout bases are substantially rectangular and have a larger dimension in the transverse direction of the course of the track than in the longitudinal direction of the course of the track. The turnout bases, in particular all turnout bases, are thus preferably located in the area of the turnout arrangement transverse to the course of the track.

The substantially rectangular turnout bases can also be moderately trapezoidal or square in the sense of the invention. However, most turnout bases have a greater extension transverse to the course of the track than along the course of the track.

The track bases of the tracks adjoining the turnout usually lie along the course of the track and have a smaller extension transverse to the course of the track than along the course of the track. The turnout arrangement preferably comprises a plurality of turnout bases arranged in a row along the longitudinal direction of the course of the track.

However, the turnout bases are preferably arranged at a distance from one another so that the turnout bases are decoupled from each other.

Preferably, the smaller dimension of the turnout bases is less than 2.6 m or approximately 2.6 m. Due to this limitation of size, the turnout bases can be transported, for example, with a conventional truck. If the turnout bases are transported at an angle, they can also have a smaller dimension of up to 2.9 m. Preferably, the track bases also have a smaller dimension of less than or equal to 2.6 m.

Preferably, it is provided that the turnout bases of the turnout arrangement extend continuously over the entire width of the turnout, so that, in particular after the frog of the turnout, the fastening areas for the main track and for the branch track are located on a turnout base.

The turnout arrangement and the track arrangement can be adapted in such a way that they have different stiffnesses in different areas or a substantially constant stiffness in their course. The shear stiffness largely depends on the shear modulus or the hardness of the elastic layer and on the cross-sectional area introducing the force. In order to obtain a smooth transition without discontinuity, for example at the transition from the track to the turnout, the elastic layer of the first turnout base can be selected in such a way that the stiffness in the area of this first turnout base corresponds to the stiffness of the last track base.

For example, it must be taken into account that the turnout bases must be of different sizes in order to be able to support the main track and the branch track leading away from the main track. The desired stiffness in the area of a turnout base or a track base can be achieved by selecting the shear modulus or the hardness of the elastic layer used in this area, in particular by selecting the material, the thickness and/or the porosity of the elastic layer.

In addition, the stiffness can also be changed or adapted in certain areas by varying or selecting the shear modulus and/or the hardness of those elastic inserts that are arranged in the area of the support points between the rail foot and the turnout base or the rail base, respectively. Thus, the stiffness can be flexibly varied and adapted in certain areas in the arrangements according to the invention.

Preferably, the type of rail fastening is selectable for the turnout arrangement and, optionally, also for the track arrangement. The turnout arrangement can be used both for high-speed turnouts with continuously inclined rails and for conventional railway turnouts with vertical rails and corresponding transitions to the inclined track area. The turnout arrangement and the track arrangement can be used for local traffic as well as for mainline railways.

BRIEF DESCRIPTION OF THE DRAWING

With reference to the figures, the invention is now further described.

Figure 1:
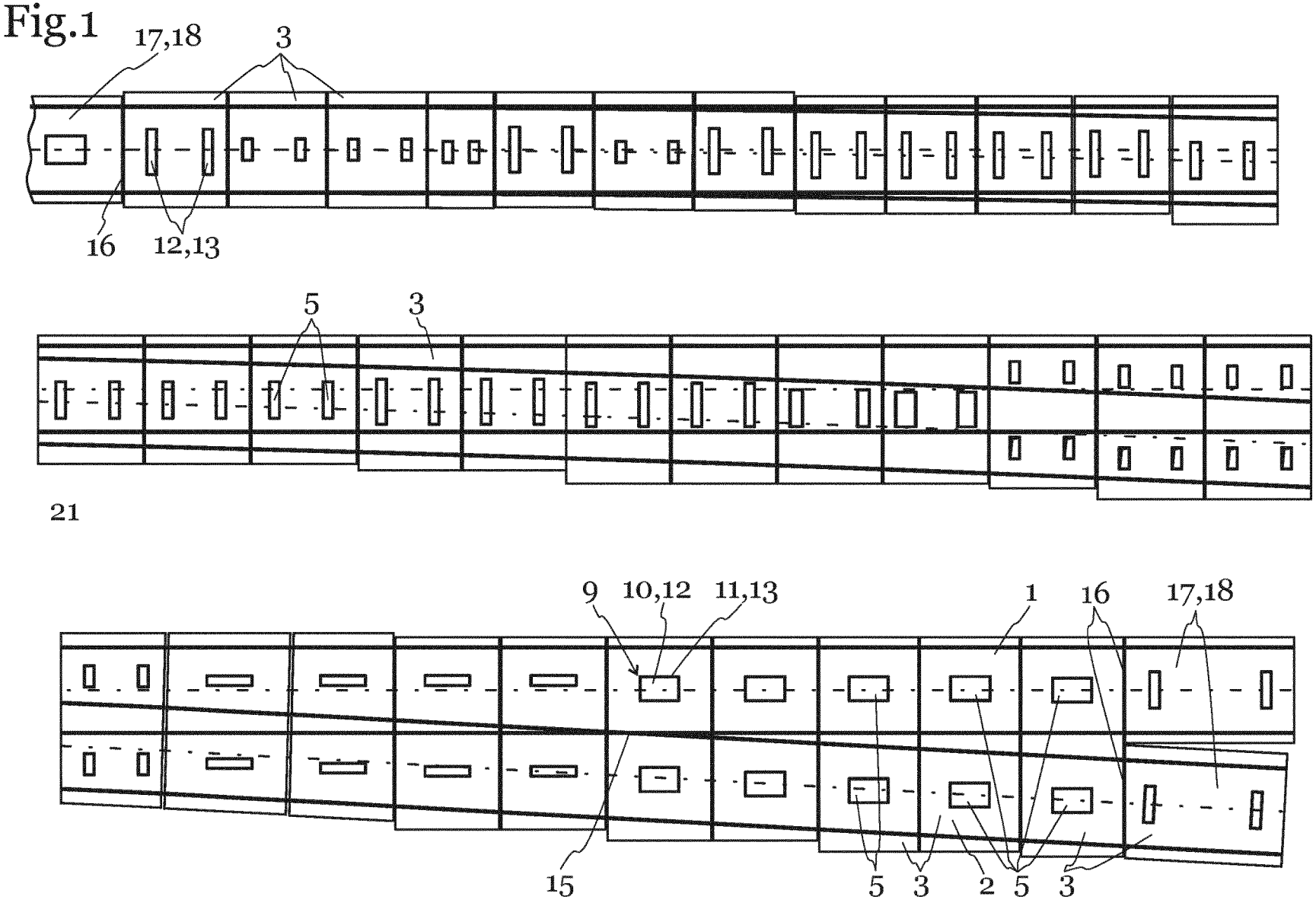
FIG. 1 shows a schematic diagram of a top view of a section of a track arrangement with the course of the track being divided into three lines for drawing reasons.

Unless otherwise stated, the reference signs correspond to the following components: Main track 1, branch track 2, turnout base 3, ground 4, casting compound 5, fastening area 6, rail support point 7, elastic layer 8, positive-locking arrangement 9, first positive-locking element 10, second positive-locking element 11, opening 12, projection 13, undercut 14, frog 15, junction 16, track 17, track base 18.

DETAILED DESCRIPTION

FIG. 1 shows a turnout arrangement of a slab track with a ballastless superstructure for forming a main track 1 and a branch track 2, which branches off from the main track 1, for railway traffic. The turnout arrangement comprises a plurality of turnout bases 3, which extend in a row, starting from the junction 16 of the incoming track 17, to the junctions 16 of the outgoing tracks 17. The turnout bases 3 lie substantially in a row along the course of the track.

In particular, a gap between the individual turnout bases 3 is kept free or filled with an elastic material so that the individual turnout bases 3 are substantially decoupled from each other. In particular, a relative movement of the turnout bases 3 to each other is permitted.

The turnout bases 3 each comprise at least one, in particular two or more, openings 12. In the present embodiment, the openings 12 are formed as through-openings which extend substantially in a vertical direction through the entire turnout base 3. The openings 12 are at least partially filled with the casting compound 5, preferably over their entire height.

On the incoming side, a track 17 with a track base 18 adjoins the turnout arrangement. On the outgoing side, two tracks 17 with one track base 18 each adjoin.

Preferably, in all embodiments, the turnout bases 3 are substantially rectangular and have a smaller dimension when measured along the course of the track than when measured transverse to the course of the track. Optionally, individual turnout bases 3 are square or trapezoidal. In particular, as a preferred embodiment, the dimension along the course of the track is less than or equal to 2.6 m, so that the turnout bases 3 can be transported easily and efficiently.

The turnout bases 3 of the turnout arrangement extend over the entire width of the turnout arrangement. In particular in the area after the frog 15, but preferably also before the frog 15, each turnout base 3 supports the main track 1 and the branch track 2. An exception may be those plates at the beginning of the turnout arrangement where the branch track 2 and the main track 1 do not yet have diverging courses.

In particular in the end area of the turnout, for example after the frog 15, the turnout bases 3 have an elongated rectangular shape and extend over the entire width of the turnout so that the main track 1 and the branch track 2 rest on this turnout base 3.

The turnout bases 3 each comprise at least one positive-locking arrangement 9 with a first positive-locking element 10 and a second positive-locking element 11. In the present embodiment, the first positive-locking element 10 is formed as an opening 12 of the turnout base 3. The second positive-locking element 11 is formed as a projection 13 of the casting compound 5 in this embodiment. The projection 13 extends into the opening 12 from below, thus creating a positive-locking retention of the turnout base 3 relative to the casting compound 5 in the horizontal plane, here in the picture plane. At least one, preferably several, in particular two or four, projections 13 are inserted into openings 12 per turnout base 3.

The cross sections of the projections 13 in the horizontal plane, which extend into a single turnout base 3, must be dimensioned in such a way that the strength of the projections 13 is sufficient to absorb the forces introduced by the rail vehicle. In particular, the maximum permissible shear forces of this cross section must not be exceeded. While in the starting area and in the end area of the turnout arrangement in the present embodiment two openings 12 and two projections 13, respectively, each are provided, in the central area of the turnout four openings 12 and four projections 13, respectively, are provided per turnout base 3. The cross sections of all projections 13 of a turnout base 3 which are relevant for the strength, are preferably added up for the strength calculation.

Figure 2:
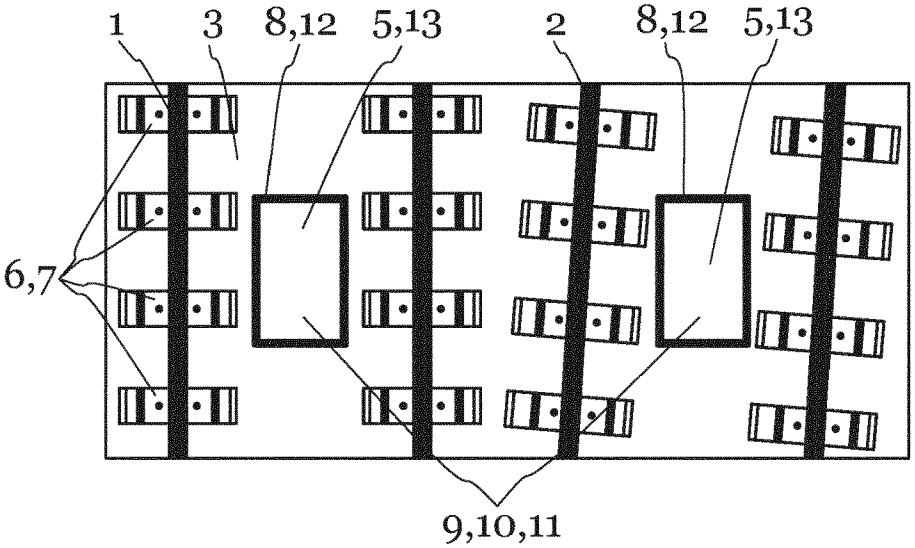
FIG. 2 shows a schematic top view of a sub-section of a turnout arrangement.

FIG. 2 shows a more detailed view of a turnout base 3, in particular a turnout base 3, which is arranged after the frog 15 of the turnout arrangement. The turnout base 3 comprises several fastening areas 6 for the main track 1 and the branch track 2.

In particular, the fastening areas 6 form the rail support points 7 for receiving the rail fasteners. Furthermore, the turnout arrangement comprises a positive-locking arrangement 9 in the area of the illustrated turnout base 3 for positively holding the turnout base 3 relative to the casting compound 5. The positive-locking arrangement 9 comprises a first positive-locking element 10 and a second positive-locking element 11, which are in positive active contact with each other. In particular, a part of the elastic layer 8 is provided between the first positive-locking element 10 and the second positive-locking element 11.

In the present embodiment, the first positive-locking element 10 is formed as an opening 12 in the turnout base 3. The second positive-locking element 11 is formed as a projection 13 of the casting compound 5, wherein the projection 13 extends into the opening 12 of the turnout base 3 from below. In particular, the opening 12 is designed as a through-opening, whereby in the present embodiment the casting compound 5 can be introduced through these openings 12 during casting. As can be seen in the illustration of FIG. 2, a majority of the area of the turnout base 3 is occupied by the fastening areas 6. The remaining areas between the fastening areas 6 may be used to provide the openings 12 to form a part of the positive-locking arrangement 9. However, the openings 12 cannot extend over the entire free area between the fastening areas 6, as otherwise the strength and/or functionality of the turnout base 3 would be compromised.

Figure 3:
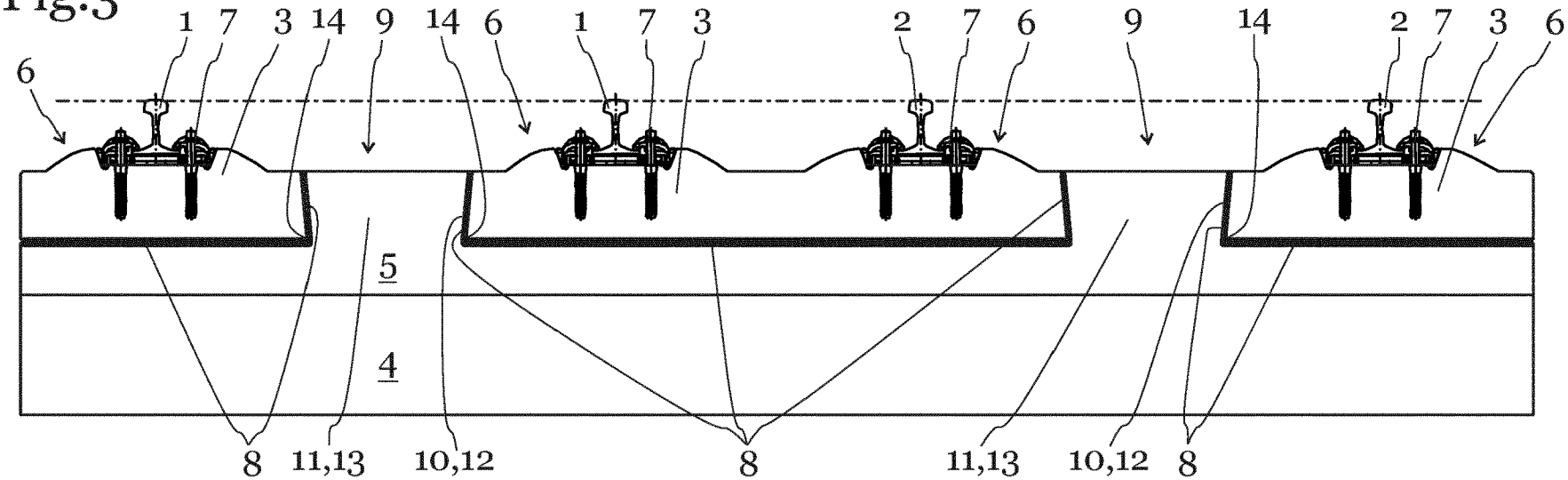
FIG. 3 shows a sectional view of the sub-section of FIG. 2.

FIG. 3 shows a sectional view of the turnout arrangement of FIG. 2, wherein the sectional plane is substantially a normal plane of the direction of the course of the track.

The turnout arrangement comprises a turnout base 3, which is arranged at a distance from the ground 4 and in particular is aligned. The space between the turnout base 3 and the ground 4 is at least partially filled with a casting compound 5. When the turnout arrangement is produced, the casting compound 5 is hardened. The turnout arrangement comprises a main track 1 and a branch track 2 branching off from the main track 1. The branch track 2 usually branches off from the main track 1 in the form of a curve. The branch track 2 is curved, but in contrast to a conventional track curve, it usually has no superelevation.

An elastic layer 8 is provided between the turnout base 3 and the casting compound 5. This elastic layer 8 is preferably made of several parts and extends between the turnout base 3 and the casting compound 5 in such a way that these two components are elastically supported relative to each other and in particular elastically decoupled from each other. Nevertheless, the turnout base 3 and the casting compound 5 are positively connected to each other. Thus, a positive-locking arrangement 9 is provided, which comprises at least one first positive-locking element 10 and at least one second positive-locking element 11.

In the present embodiment, two first positive-locking elements 10 and two second positive-locking elements 11 are provided. The first positive-locking elements 10 are formed as openings 12, which extend through the turnout base 3. The second positive-locking elements 11 are formed as projections 13 of the casting compound 5, which extend into the openings 12 of the turnout base 3. The elastic layer 8 is arranged between each projection 13 and the associated opening 12. The elastic layer 8 is also provided between the, preferably substantially horizontal, underside of the turnout base 3 and the casting compound 5.

This design of the positive-locking arrangement 9 forms a positive, elastic coupling of the turnout base 3 with the casting compound 5, which acts in the horizontal plane.

In addition, a vertically acting positive connection is also formed in the present embodiment. In this respect, the projection 13 has an undercut 14 into which a part of the turnout base 3, in particular a part of the opening 12 of the turnout base 3, extends. Preferably, the opening 12 is widened towards the top, so that an undercut area is formed when this opening 12 is filled with the casting compound 5. Due to the arrangement of the elastic layer 8 in this area, the vertically positive connection is elastic.

Preferably, in all embodiments, an elastic layer 8 is provided in the area of the rail fastenings. In this respect, an elastic insert is usually provided between the rail support point 7 and the rail foot. Advantageously, by varying the hardness or shear modulus of this/these elastic insert(s), the elasticity and in particular the stiffness of the track 17 can be influenced in two different areas.

The first area can be varied, for example, by selecting the elastic layer 8. For example, different materials or dimensions with different shear moduli or hardnesses can be used. Additionally, when using an elastic rail insert, the stiffness can further be varied. This flexibility allows the comfort of the present turnout arrangement and track arrangement to be flexibly adapted and improved.

The invention claimed is:

1. A turnout arrangement of a slab track with a ballastless superstructure for forming a main track and a branch track, which branches off from the main track, for railway traffic, the turnout arrangement comprising:

a plurality of prefabricated turnout bases of untensioned reinforced concrete;

a casting compound, which is cast and hardened between the plurality of prefabricated turnout bases and a ground surface; and a plurality of fastening areas, comprising rail support points provided on the plurality of prefabricated turnout bases for fastening of the main track and the branch track as well as for fastening further turnout components;

wherein the plurality of prefabricated turnout bases are elastically supported, wherein at least one positive-locking arrangement is provided per prefabricated turnout base for positively holding the prefabricated turnout base horizontally with respect to the casting compound, wherein the positive-locking arrangement comprises first and second positive-locking elements, which are in positive active contact with one another, wherein the first positive-locking element is a casting opening kept free in the prefabricated turnout base, and wherein the second positive-locking element is a projection of the casting compound extending into the casting opening, wherein the projection and the casting opening is are configured such that introduced horizontal shear forces are below the maximum permissible load limit of the prefabricated turnout base and the projection, and wherein an elastic layer is provided per prefabricated turnout base between the projection and the prefabricated turnout base, and wherein the elastic layer for at least one prefabricated turnout base is disposed between the prefabricated turnout base and the casting compound and extends continuously under a pair of adjacent rail support points that includes a first rail support point for the main track and a second rail support point for the branch track.

2. The turnout arrangement according to claim 1, wherein the plurality of prefabricated turnout bases are elastically supported individually, and are supported or mounted free of constraint forces.

3. The turnout arrangement according to claim 1, wherein the plurality of prefabricated turnout bases are elastically supported horizontally with respect to at least one of (a) the ground surface and (b) each other, and transverse to the course of the track.

4. The turnout arrangement according to claim 1, wherein a gap is kept free between each of the plurality of prefabricated turnout bases, and elastic support for the plurality of prefabricated turnout bases is provided by an elastic support with respect to the ground surface.

5. The turnout arrangement according to claim 1, wherein the plurality of prefabricated turnout bases are elastically supported in the vertical direction.

6. The turnout arrangement according to claim 1, wherein the elastic layer is arranged between the plurality of prefabricated turnout bases and the casting compound for elastic decoupling of the plurality of prefabricated turnout bases.

7. The turnout arrangement according to claim 6, wherein the elastic layer is formed in several parts.

8. The turnout arrangement according to claim 1, wherein the elastic layer is arranged between the first and second positive-locking elements for horizontal elastic support and for elastic decoupling of the plurality of prefabricated turnout bases.

9. The turnout arrangement according to claim 1, wherein the at least one positive-locking arrangement configured to positively hold the turnout base vertically with respect positive-locking elements for vertical elastic support and for elastic decoupling of the plurality of prefabricated turnout bases.

10. The turnout arrangement according to claim 1, wherein the second positive-locking element has an undercut such that a region located at the top of the second positive-locking element projects beyond a region located further down in the horizontal direction of the second positive-locking element or is designed to widen towards the top, and a part of the turnout base extends into the undercut so that vertical positive connection is formed.

11. The turnout arrangement according to claim 1, wherein two openings are provided per turnout base, and the projection is configured to extend in each of the two openings.

12. The turnout arrangement according to claim 1, wherein a smallest overall cross section of the projection extending into a turnout base is bigger than a cross section which, taking into account the strength of the casting compound, is sufficient to absorb horizontal forces introduced by a rail vehicle without damage.

13. The turnout arrangement according to claim 1, wherein the plurality of prefabricated turnout bases have a rectangular design and have a greater dimension in the transverse direction of the course of the track than in the longitudinal direction of the course of the track.

14. The turnout arrangement according to claim 13, wherein the smaller dimension of the plurality of prefabricated turnout bases is less than or equal to 2.6 meters.

15. The turnout arrangement according to claim 1, wherein the plurality of prefabricated turnout bases extend continuously over the entire width of the turnout and comprise or form fastening areas for the main track and for the branch track at least after a frog of the turnout.

16. The turnout arrangement according to claim 1, wherein the elastic layer of a first turnout base of said plurality of prefabricated turnout bases has a different stiffness and/or a different shear modulus, than the elastic layer of a second turnout base of said plurality of prefabricated turnout bases adjacent said first turnout base.

17. A track arrangement, comprising:

a turnout arrangement according to claim 1; and a plurality of tracks adjoining the junctions of the turnout arrangement;

wherein the plurality of tracks are configured as slab tracks with a ballastless superstructure and comprise a plurality of prefabricated track bases of untensioned reinforced concrete, a casting compound, which is cast and hardened between the plurality of prefabricated track bases and the ground surface, and a plurality of fastening areas comprising rail support points are provided on the plurality of track bases for fastening of the plurality of tracks, wherein the plurality of prefabricated track bases are elastically supported.

18. The track arrangement according to claim 17, wherein an elastic layer is arranged between the plurality of prefabricated track bases and the casting compound for elastic decoupling of the plurality of prefabricated track bases.

19. The track arrangement according to claim 18, wherein the elastic layer is formed in several parts.

20. The track arrangement according to claim 17, wherein the elastic layer of a prefabricated track base has a different stiffness and/or a different shear modulus, than the elastic layer of a prefabricated turnout base of the turnout arrangement or an adjacent track base.

* * * * *